US007182651B2

(12) United States Patent
Waters et al.

(10) Patent No.: US 7,182,651 B2
(45) **Date of Patent: *Feb. 27, 2007**

(54) LIGHTING CONNECTOR WITH REMOVABLE PIN

(75) Inventors: Colin Waters, Pacoima, CA (US); Peter Tien, Taoyuan (TW)

(73) Assignee: TMB, Pacoima, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/319,323

(22) Filed: Dec. 27, 2005

(65) Prior Publication Data

US 2006/0099860 A1 May 11, 2006

Related U.S. Application Data

(62) Division of application No. 10/715,884, filed on Nov. 17, 2003, now Pat. No. 6,979,233.

(51) Int. Cl.
*H01R 13/64* (2006.01)

(52) U.S. Cl. ..... 439/681

(58) Field of Classification Search ..... 439/680, 439/681, 674, 677, 166, 956
See application file for complete search history.

(56) References Cited

U.S. PATENT DOCUMENTS

| | | | | |
|---|---|---|---|---|
| 3,120,985 A * | 2/1964 | Hubbell | 439/166 |
| 4,386,333 A * | 5/1983 | Dillan | 336/107 |
| 5,178,561 A * | 1/1993 | Lindeberg et al. | 439/571 |
| 5,254,019 A | 10/1993 | Noschese | |
| 6,394,856 B1 | 5/2002 | Wertz | |

* cited by examiner

*Primary Examiner*—Tho D. Ta
(74) *Attorney, Agent, or Firm*—Fish & Richardson P.C.

(57) ABSTRACT

A dual voltage connector having keyway portions enabling protection of the connector against unintentionally using it with a long voltage. A higher voltage version of the connector, which supplies the voltage, is protected. In a female version of the connector, a plug is placed in the higher voltage portion of the connector.

13 Claims, 6 Drawing Sheets

LIGHTING CONNECTOR WITH REMOVABLE PIN

CROSS-REFERENCE TO RELATED APPLICATIONS

This application is a divisional application of and claims priority to U.S. application Ser. No. 10/715,884, filed on Nov. 17, 2003 now U.S. Pat. No. 6,979,233.

BACKGROUND

The entertainment lighting industry is serviced by a number of different manufacturers. Common connectors are often used so that different units can be interchanged. For example, a controller from Company A may be used to control a light from Company B. A lighting designer, who is often not associated with either company, may select components, making it crucial that the units interconnect.

Therefore, different de-facto standards of connectors are often found. The standard connectors, however, may be used with different voltages. For example, units are often used with 120 volt power supplies for incandescent fixtures, for example. Other units, for example for arc type light fixtures, often use 208 volts, usually via a 2 phase supply. Systems may also use 220 volts or other voltages.

Standard 19 pin cables and connectors are currently used industrywide to distribute electrical power to six circuit loads of lighting instruments that usually handle up to 20 amperes. These connectors are often called Socapex connectors. Many different types and different brands of these connectors are in use. One of these is available from the assignee of this application, TMB, Inc.

A representative one of these connectors is diagrammed in FIGS. 1A–1D. FIGS. 1A and 1B show a female version of the connector in which female contacts 100 are placed in a substantially concentric array, around a central pin 19. The male connector is shown in FIGS. 1C and 1D and includes the male pins 105 which mate with the respective female pins 19. Any male connector of this type can be plugged into any female connector of this type.

A standard wiring layout of these cables is also typically used. The standard wiring that is used is in Table 1.

TABLE 1

| CIRCUIT NUMBER | HOT | NEUTRAL | GROUND |
|---|---|---|---|
| Circuit 1 | pin 1 | pin 2 | pin 13 |
| Circuit 2 | pin 3 | pin 4 | pin 14 |
| Circuit 3 | pin 5 | pin 6 | pin 15 |
| Circuit 4 | pin 7 | pin 8 | pin 16 |
| Circuit 5 | pin 9 | pin 10 | pin 17 |
| Circuit 6 | pin 11 | pin 12 | pin 18 |

SUMMARY

The present inventors recognized that the standard cables and connectors which were originally used for 120 volt systems have been increasingly used in both 120 volt and 208 volt systems. The same form factor connector is therefore used for both voltages: 120 volts and 208 volts. While this is convenient for maintaining inventory of different lights, the practice may be dangerous since it allows connection of 120 volt light to a 208 volt supply. This can damage the light. It can also be dangerous to personnel, since the cables and units often are supplied with a voltage that the insulation was not intended to handle.

The present system teaches a special modification to a standard connector that prevents inadvertent mating between different voltages in a single connector style.

In an embodiment, special inserts are used to mark connectors to determine whether they are used for 120 volt or 208 volt use. The inserts may be removable, and may prevent 120 volts lighting systems from being connected into a 208 volt supply.

In an embodiment, an unused pin is designated as a "key way" to set whether the system is intended for 208 volt or 120 volt. The pins allow 208 volt connectors to be connected to one another. However, 120 volt lights/loads are configured in a way that prevents them from being connected to 208 volt supplies.

BRIEF DESCRIPTION OF THE DRAWINGS

These and other aspects will now be described with reference to the accompanying drawings, wherein.

DETAILED DESCRIPTION

Many standard connectors, including the Socapex connector, have unused pins, or extra supply and/or ground or pins. According to the present system, the unused pins are fitted with one of three different items, and the fit between the items effectively forms a keyway that prevents lower voltage loads, e.g., 110 volt lights, from being connected to higher voltage supplies, e.g., 208 volt sources.

Figure 1A:
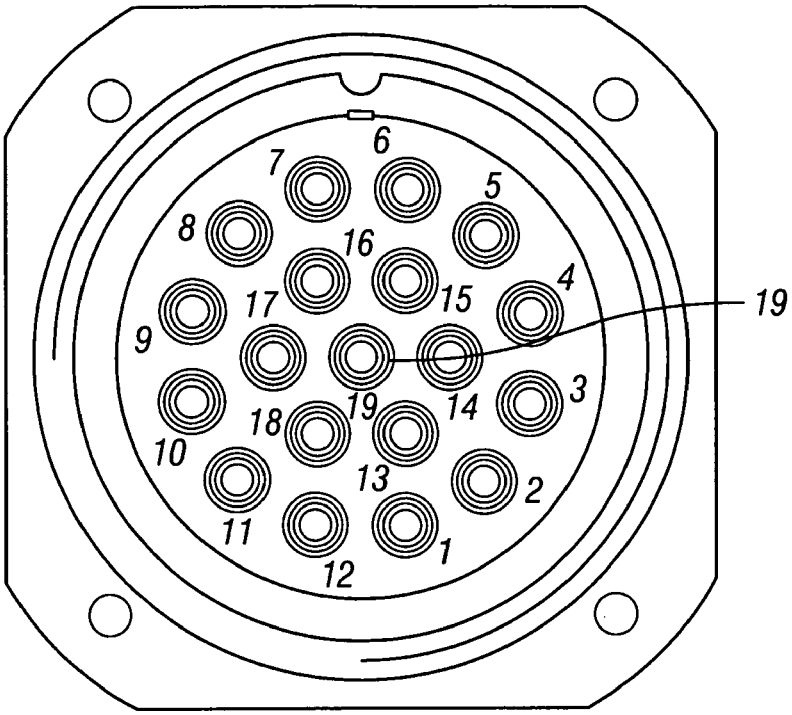
FIG. 1A (Prior Art)
FIGS. 1A–1D show a generic version of the pin Socapex connectors.
Figure 1B:
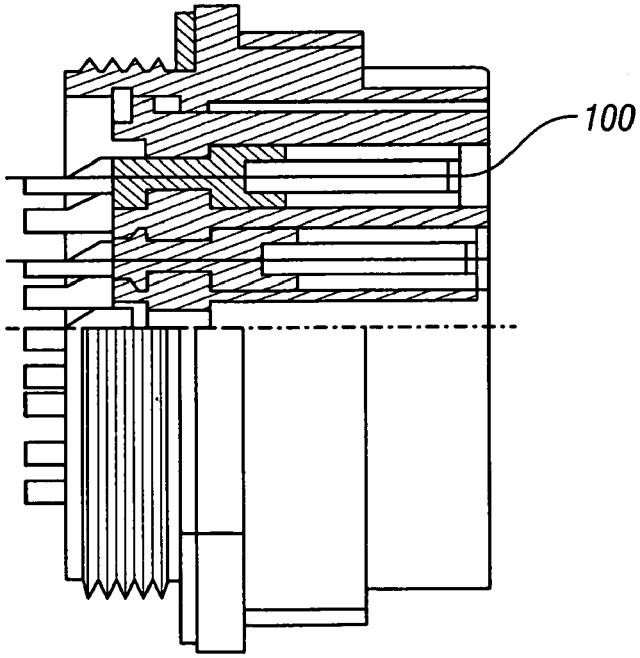
FIG. 1B (Prior Art)
Figure 1C:
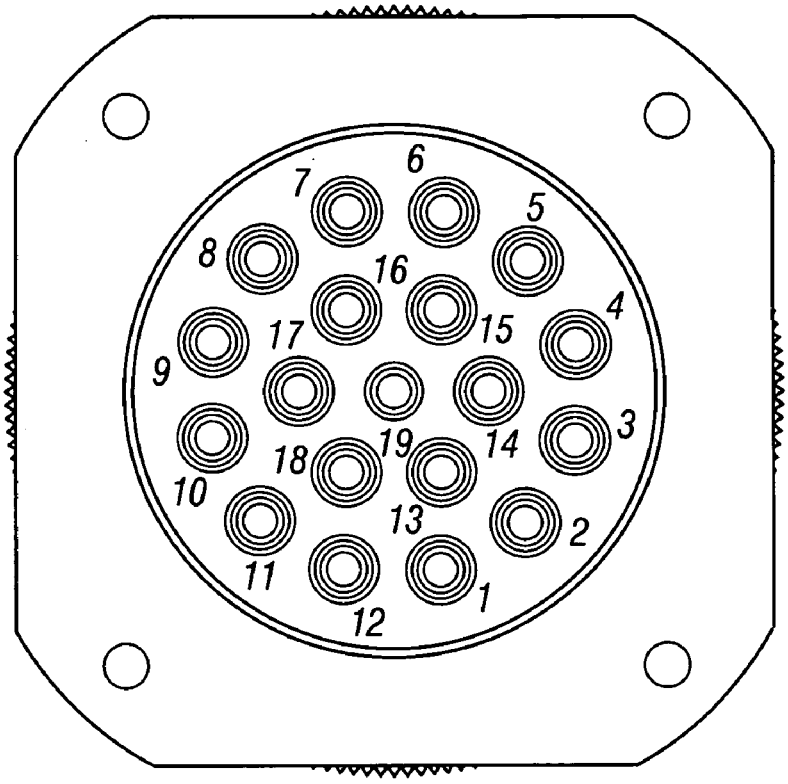
FIG. 1C (Prior Art)
Figure 1D:
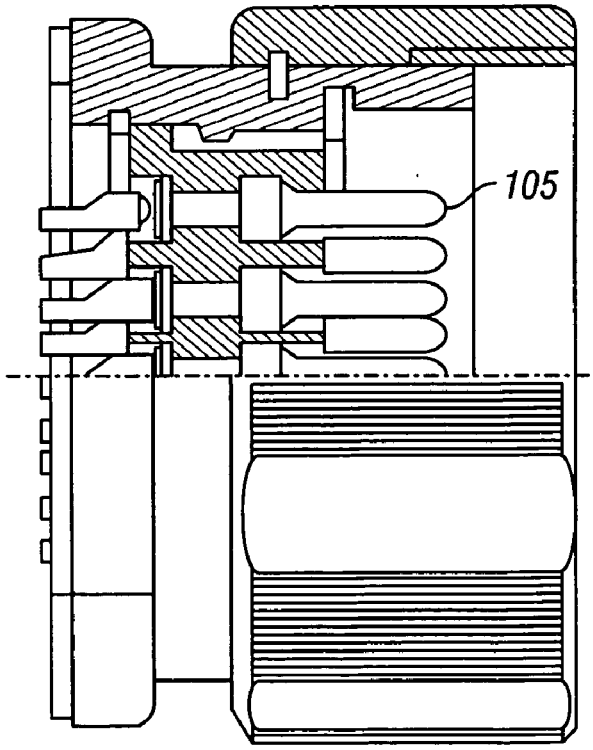
FIG. 1D (Prior Art)
Figure 2:
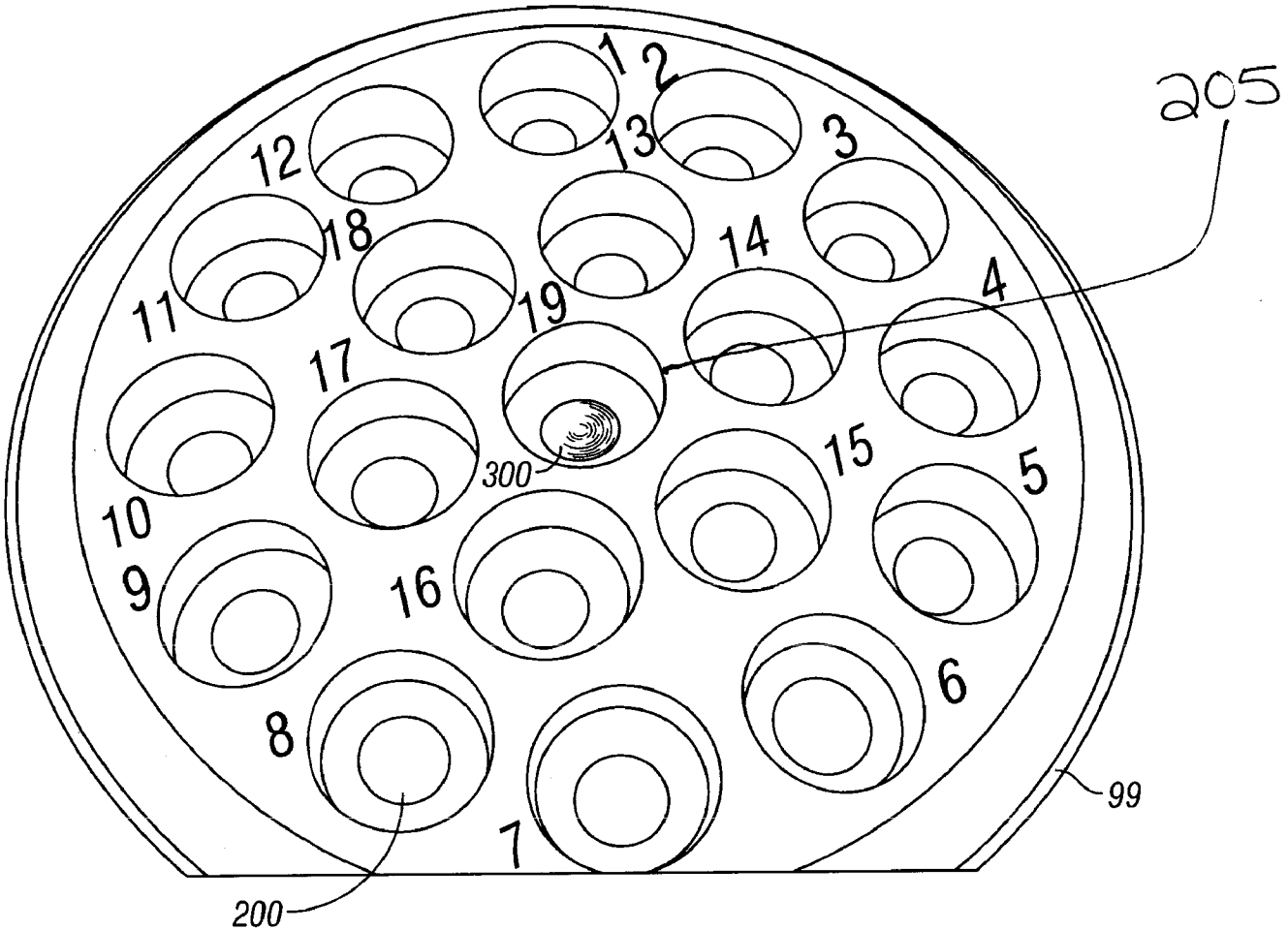
FIG. 2 shows a female connector with a plugged keyway.

In an embodiment, the connector has a spare central pin. FIG. 2 shows a version of the connector, configured for a 208 volt female connector with its central pin blocked. Effectively, each female 19 pin connector with the plug installed is designated as being for 208 volts. 19 pins are provided, with each of the pins such as 200, including a metal contact therein for connection to a corresponding supply of power. However, the central unused pin, here designated as 205, is blocked with a special plug that fills within the contact hole and prevents insertion of any pin into that central contact hole.

Figure 3:
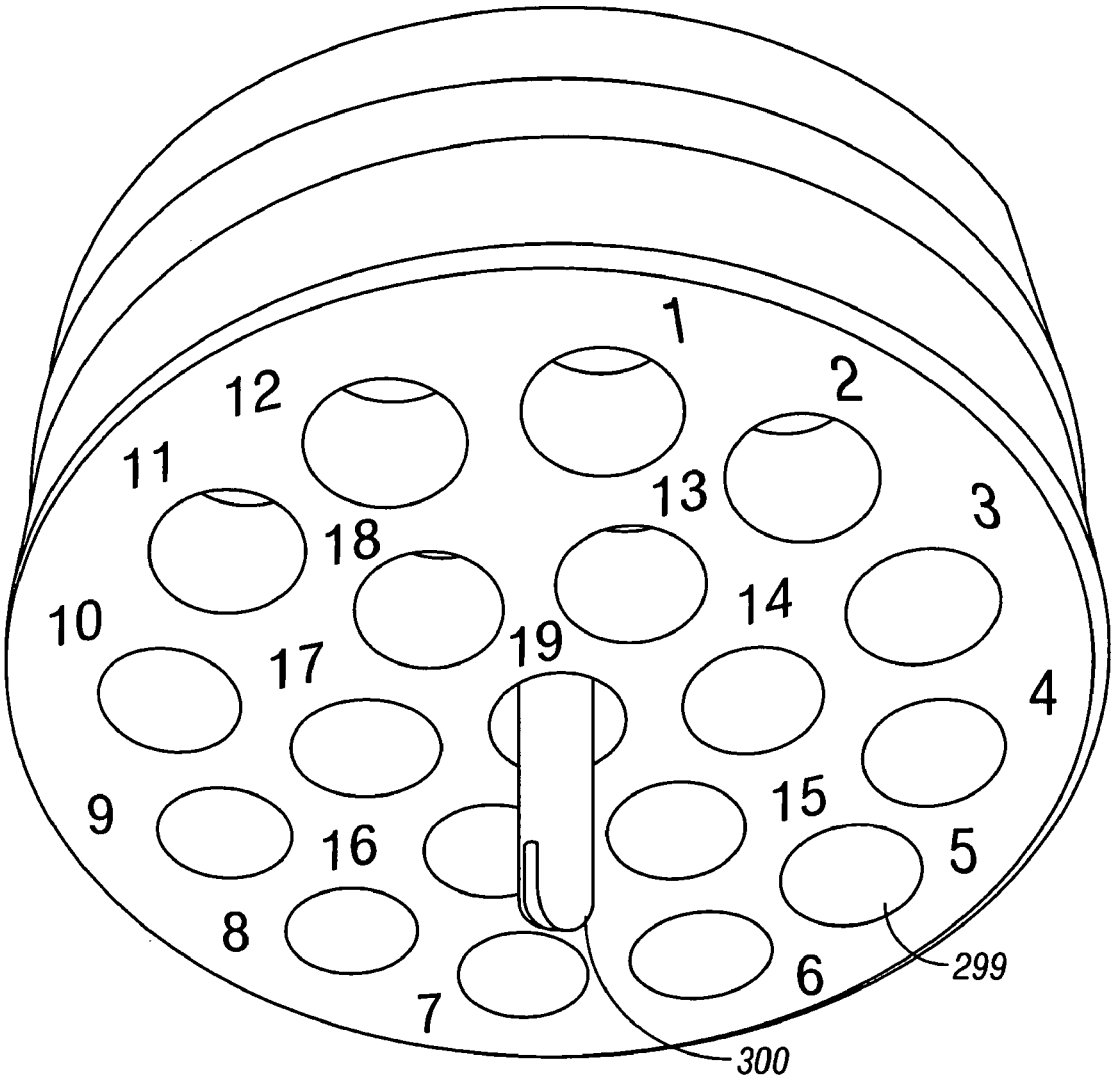
FIG. 3 shows a male connector with a key portion.

The male connector is also correspondingly coded. FIG. 3 shows a male connector which is coded for 120 volt use. A special pin 300 is inserted into the central unused contact portion of the male connector. This codes the male connector as a 120 volt connector. Note that this 120 volt coded male connector, has a centrally extending pin 300 in the corresponding location to the plug in the female connector. Therefore, this (110 volt coded) male connector cannot be inserted correspondingly into the 208 volt coded (plugged) female connector 200. Rather, the extending pin 300 prevents its connection into the wrong kind of connector such as 200.

Figure 4:
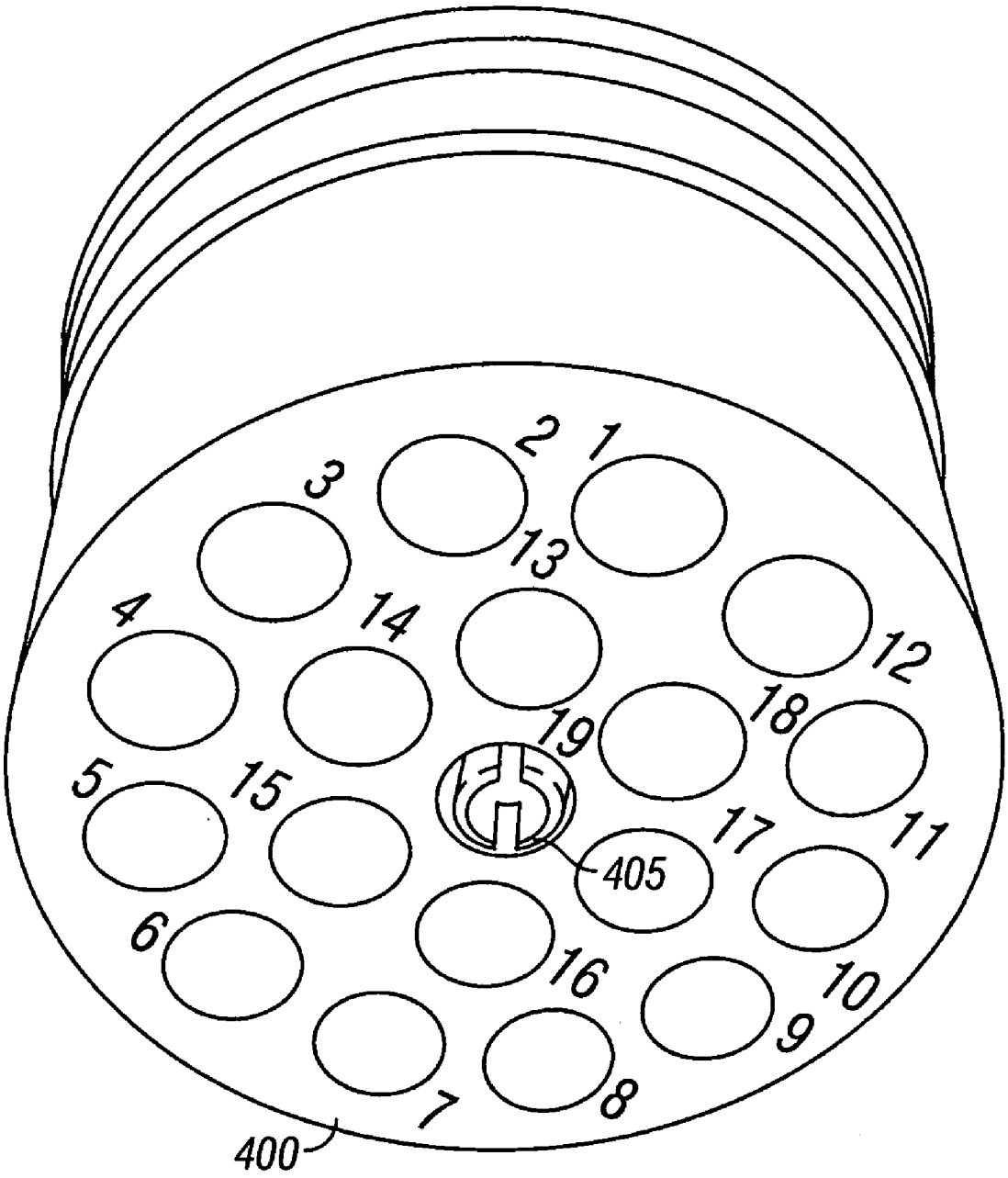
FIG. 4 shows a female connector with an open keyway.

However, connector 300 can in fact be inserted into a corresponding female connector which has been coded for 120 volts. FIG. 4 shows a corresponding female connector 400 with a metal pin 405 inserted in the central hole. The metal pin 405 includes a central aperture within which the outer portion of the pin 300 can connect. Therefore, the connector 299 can in fact mate with the connector 400, but can not mate with the connector 99.

Figure 5:
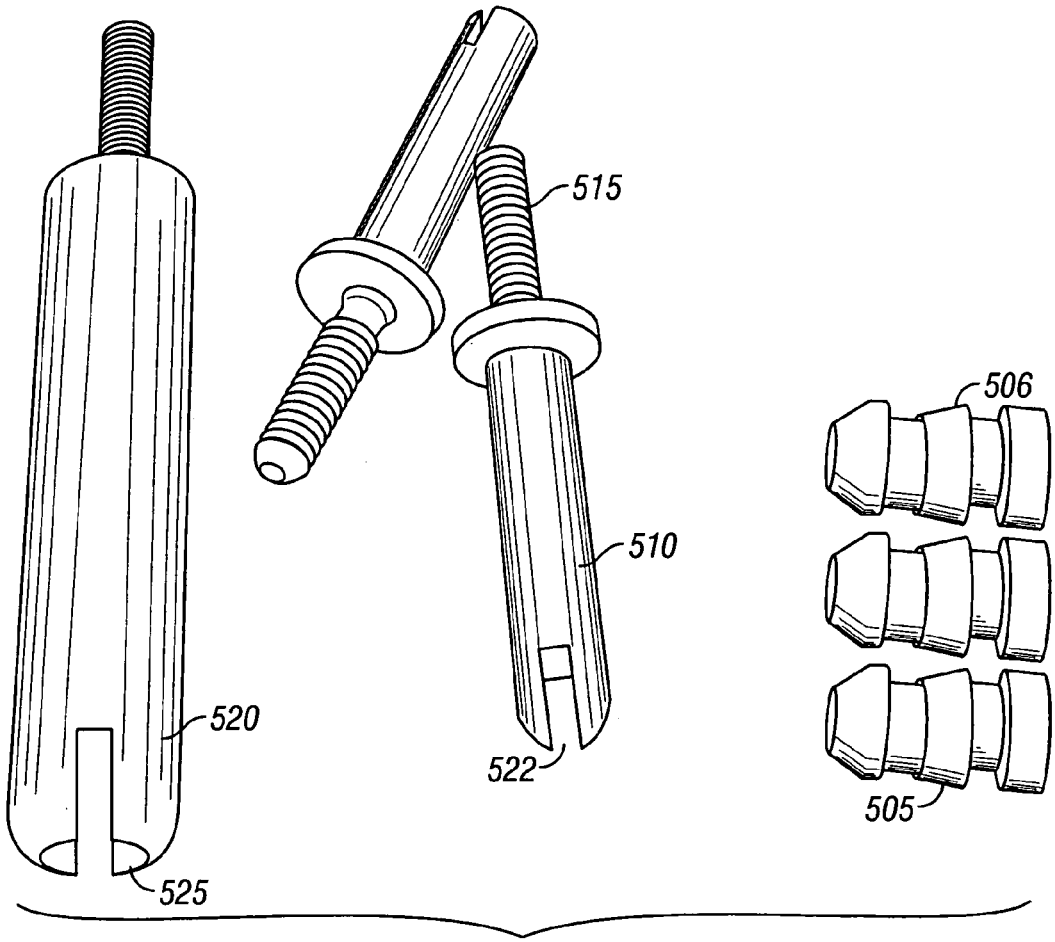
FIG. 5 shows a retrofit set.

Many of these connectors are sold, as shown, with the metal contacts either removed or separately available. Whether removed or not, however, each of these contacts may be modified and/or retrofitted using the connector set 500 that is shown in FIG. 5. The connector set 500 includes a first plug 505, which is sized to fit within the central hole and 205 shown in FIG. 2. One of the plugs 505 is placed within an unused pin of the female connector of the 208 volt supply.

A keyway pin 510 is also provided which has a threaded shank 515. The shank 515 may be used to hold the keyway pin into place within the connector. A key way pin 510 is configured to go within the unused pin of the male connector. The surfaces of keyway pin 510 prevent it from being inserted into a connector which has its central hole plugged.

The female keyway pin 520 is placed within the central hole of 120 volt supply connector. The female keyway pin 520 has a central hole 525 which is sized to receive the outer surface of the keyway pin 510 therein. In this way, a keyway pin 510 can fit entirely within the central orifice 525. Note that both the keyway pin 510 and the female key way pin 520 include insertion force relief ends 522, which facilitate the connection of one of the pins into the other.

In this way, the physical layout of the connectors mechanically prevents a 120 volt lamp connector from being inserted into a 208 volt supply connector, even though the two connectors each have the same form factor. A yellow rubber band may also be included with the set, marked "warning 208 volts", and supplied for fitting over the 208 volt designated connectors.

The above has described one embodiment of this system. However, it should be understood that this basic idea could be used with many other connectors within the entertainment lighting industry. For example, while only 120 and 208 volts are described, it should be understood that the basic system can be used with different voltage pins. This may include 220 volts, or 440 volts or other voltages.

Also, this system allows a 208 volt light to be connected into a 120 volt supply, since this will typically not cause dangers, and at worst, the light will simply not operate. However, other keyways can be used in a similar way.

In addition, the position of the plugs and pins can be reversed.

This system is also usable with other formats of connectors, as long as the connector includes a spare pin. The spare can be in the center as in this connector, or may be in any other location. For systems with a common ground, this may also be used in a pin that does not have a spare pin, by using the pins/plug arrangement in place of one of redundant power or ground connections.

The above has described using the keyway to prevent a higher voltage supply to a lower voltage system. However, it can also be used to prevent different kinds of incompatible voltages from being used. For example, the pins can be used to prevent an AC unit from being powered with a DC source or vice versa. It can also be used to prevent incompatible signals from being provided, also. Any other prevention can also be done, which allows preventing a unit which needs a first kind of electricity from receiving a second kind of electricity.

All such modifications are intended to be encompassed within the following claims, in which:

What is claimed is:

1. A method, comprising:

marking a first portion of a first connector having a plurality of pins used to supply a first type of electricity, by blocking one of the pins of the first connector as a blocked location;

marking a corresponding location of a second connector which mates with the first connector, but is used with a second type of electricity, which is incompatable with said first type of electricity, by forming a protruding portion in a corresponding area to the blocked location, thereby preventing the second connector used for the second type of electricity from being inserted into the first connector used for the first type of electricity, where said one pin is substantially the same as other pins on the second connector.

2. A method as in claim 1, where the first type of electricity is a DC voltage, and the second type of electricity is an AC voltage.

3. A method as in claim 1, wherein each of the first and second connectors have a plurality of pins, and where the first connector is a female connector and the second connector is a male connector.

4. A method as in claim 3, wherein each of the first and second connectors are mating connectors, with 19 pins, said first connector being a female connector and said second connector being a male connector.

5. A method as in claim 3, wherein each of the first and second connectors have a spare pin which is not used for electrical connection, and said first portion of the first connector and said corresponding portion of the second connector use an area of said spare pin.

6. A method as in claim 1, where the first type of electricity is a first higher voltage, and the second type of electricity is a second lower voltage.

7. A method as in claim 6, wherein the higher voltage is 208 volts and the lower voltage is 120 volts.

8. A method as in claim 6, further comprising marking a first portion of a third connector used to supply a lower voltage with a corresponding female pin, which mates with the protruding portion.

9. A method, comprising:

forming a first version of a first connector intended for use with a higher voltage, having a specified portion which is blocked;

forming a second version of said first connector, intended for use with a higher voltage, having said specified portion which is open; and forming a first version of a second connector that mates with said first connector, and is intended for use with said lower voltage, and which has a protruding portion that protrudes by a length longer than any other protruding portions in said first version of said second connector in a location corresponding to said specified portion which is blocked, wherein said protruding portion is a pin, of substantially the same shape as pins that carry said voltages.

10. A method as in claim 9, further comprising forming a second version of said second connector that is intended for use with said higher voltage, and does not have said protruding portion.

11. A connector, comprising:

a first version of a connector of a first specified form factor, intended for use with a first kind of electricity;

a second version of the connector of the first specified form factor, intended for use with a second kind of electricity that is incompatible with said first kind of electricity; and a physical blocking part, inserted into a position of a pin of said connector, that prevents a connector for said first kind of electricity from being used with a mating connector for said second kind of electricity, wherein said position is adapted to accept a pin that is substantially the same size as a pin used to carry said electricity.

12. A connector as in claim 11, where said first kind of electricity is a higher voltage, and said second kind of electricity is a lower voltage.

13. A connector as in claim 11, where said first kind of electricity is a DC voltage, and said second kind of electricity is an AC voltage.

* * * * *